US006237574B1

(12) United States Patent
Jamrog et al.

(10) Patent No.: US 6,237,574 B1
(45) Date of Patent: May 29, 2001

(54) EVAPORATIVE EMISSION CANISTER FOR AN AUTOMOTIVE VEHICLE

(75) Inventors: James Richard Jamrog, Novi; Michael Anthony Pierce, Farmington Hills; Philip Jeffrey Johnson, Ann Arbor, all of MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 09/294,842

(22) Filed: Apr. 20, 1999

(51) Int. Cl.[7] ..... F02M 33/02
(52) U.S. Cl. ..... 123/519; 123/518; 123/198 D
(58) Field of Search ..... 123/519, 520, 123/521, 518, 516, 198 D

(56) References Cited

U.S. PATENT DOCUMENTS

| | | | | |
|---|---|---|---|---|
| 4,853,009 | | 8/1989 | Turner et al. | 55/387 |
| 5,060,620 | * | 10/1991 | Oslapas | 123/519 |
| 5,148,793 | | 9/1992 | Reddy | 123/520 |
| 5,337,721 | | 8/1994 | Kasuya et al. | 123/519 |
| 5,456,237 | | 10/1995 | Yamazaki et al. | 123/520 |
| 5,460,136 | | 10/1995 | Yamazaki et al. | 123/519 |
| 5,477,836 | * | 12/1995 | Hyodo et al. | 123/519 |
| 5,538,543 | | 7/1996 | Watanabe et al. | 96/131 |
| 5,653,211 | | 8/1997 | Ishikawa | 123/520 |
| 5,957,114 | * | 9/1999 | Johnson et al. | 123/519 |
| 5,988,145 | * | 11/1999 | Horiuchi et al. | 123/519 |

* cited by examiner

*Primary Examiner*—Henry C. Yuen
*Assistant Examiner*—Mahmoud Gimie
(74) *Attorney, Agent, or Firm*—Jerome R. Drouillard

(57) ABSTRACT

An evaporative emissions canister includes a housing containing a hydrocarbon adsorbing material, such as carbon. The canister may be configured to such that a portion acts as a buffer canister of such that the entire canister is used to adsorb hydrocarbon emissions. The canister housing is generally cylindrical with a reduced cross-sectional area portion and is configured in a manner to allow flow along a relatively straight line.

16 Claims, 4 Drawing Sheets

EVAPORATIVE EMISSION CANISTER FOR AN AUTOMOTIVE VEHICLE

FIELD OF THE INVENTION

This invention relates to evaporative emission systems for automotive vehicles, and more particularly to evaporative emissions canisters.

BACKGROUND OF THE INVENTION

Conventional automotive evaporative systems include a carbon canister communicating with a fuel tank to adsorb fuel vapors from the fuel tank. The carbon canister adsorbs the fuel vapor until it is saturated, at which time, the fuel vapor is desorbed from the carbon canister by drawing fresh air therethrough. Such a system is shown in FIG. 1. System 10 includes fuel tank 12 coupled to carbon canister 14 and engine 16 via vapor purge lines 17 and 24, respectively. Fuel vapor from tank 12 flows through line 17 into canister 14, where the fuel is adsorbed onto the carbon. Fresh air is then emitted through vent port 18 to atmosphere. When the canister becomes saturated with fuel, engine controller 19 commands valve 20 to open so that the fuel may be desorbed from the carbon and flow to engine 16 via purge line 24.

Occasionally, it may be necessary to purge the canister when both the canister is full and a large vapor volume exists in the fuel tank. Thus, upon purging, in the system described with reference to FIG. 1, vapor is drawn from both the canister and the engine. As a result, the large vapor volume flowing directly from the tank to the engine may cause the engine to temporary run in an undesirably rich condition. To prevent this, a relatively small carbon canister 26, typically termed a buffer canister, is disposed between the fuel tank and the engine. This buffer canister 26, due to its relatively small size, quickly saturates such that the vapors flowing to the engine may break through the carbon bed to be consumed by the engine. The effect of the buffer canister is to reduce any large hydrocarbon or fuel vapor spikes going to the engine to prevent the over rich condition. In other words, the buffer canister acts to dampen any fuel vapor spikes typically flowing directly from the fuel tank to the engine.

The disadvantage with this approach is primarily due to the fact that a secondary canister must be utilized in the system. This creates added expense due to couplings, vapor lines, associated hardware and general system complexity. To overcome these disadvantages, some systems utilize a vapor purge line flowing directly from the tank to the primary carbon canister, with the purge line being embedded deep into the carbon bed. Such a system is depicted in FIG. 2. In this system, when fuel vapor from the fuel tank 12 is to be purged directly into engine 16, the fuel vapor must at least go through a portion of the primary carbon canister, shown at bracket 28. Thus, a portion of the canister acts to buffer any hydrocarbon spikes from the fuel tank.

The inventors of the present invention have found certain disadvantages with the system described in FIG. 2. For example, in order to utilize a portion of the primary canister as a buffer, fuel vapor line 17 must necessarily penetrate into the carbon bed. Because of this, manufacturing issues arise in that the vapor purge line must be sealed in a manner so as to prevent leakage between the line and the atmosphere at the intersection with the primary canister. In addition, the purge line must contain a screen or filter to prevent the carbon from dislodging from the canister. Furthermore, the amount of penetration is determined on a vehicle line basis. Thus, a relatively small engine may require a certain volume for the buffer whereas a relatively large engine may require a different volume. This fact requires unique manufacturing tooling to precisely locate the depth of the fuel tank purge line within the carbon canister.

The inventors of the present invention have found further disadvantages with both prior art systems. For example, because the relatively constant cross-sectional area of the canister, vapor may inadvertently break through the vent port. In addition, these canisters are generally laid out such that the vapor flows through the canister in a serpentine manner. This may cause an increase in the flow restriction, which may have the effect of premature shutting off of the fuel fill nozzle, for example. Also, to accommodate various vehicle line applications, each system may require a plurality of different size canisters located in a variety of positions throughout the system, making packaging on a vehicle a concern.

SUMMARY OF THE INVENTION

An object of the present invention is to provide an easily manufacturable, multiple application carbon canister which overcomes the disadvantages of prior art canisters. This object is achieved, and disadvantages of prior art are overcome, by providing a novel evaporative emission canister for an evaporative emission system.

Accordingly, an evaporative emissions canister is provided for an evaporative emission system. The system includes a fuel tank coupled to an engine via a vapor purge line. The canister, in turn, is coupled to the fuel tank and the engine. The canister is a generally cylindrical housing defining a circumference and has a first, relatively smaller cross-sectional area portion and a second, relatively larger cross-sectional area portion, with a tapered section therebetween. At the end of the canister opposite the first portion, a third relatively smaller cross-sectional area portion is provided, with a second tapered section between the second and third portions.

The housing contains hydrocarbon adsorbing material for adsorbing hydrocarbons from fuel vapor flowing therethrough. A vent port is formed on the third portion to vent air to atmosphere upon adsorption of hydrocarbons and for admits air upon desorption of hydrocarbons during a purging operation of said canister. A purge port is formed on the first portion and is adapted for connection to the engine to allow desorbed hydrocarbon to flow thereto. An intermediate port is formed on the second portion and disposed between the vent port and the purge port, with the intermediate port being selectively coupled to the fuel tank.

The second plenum is preferably adapted to receive at least one standoff. The standoff separates the first and second hydrocarbon adsorbing zones. The standoff is sufficiently sized so as to accommodate a plurality of sizes of the first hydrocarbon adsorbing zone, respectively. The canister may also include a biasing means to bias the first and the second hydrocarbon adsorbing zones in a compressed manner.

Accordingly, an advantage of the present invention is ease of manufacturability and reduced manufacturing costs.

Another advantage of the present invention is that a multiple application canister may be produced and slightly adapted for a particular vehicle line.

Another, more specific advantage is the reduced cross sectional area of the first zone creates a high concentration of fuel vapor therein during adsorption, thereby increasing the mass ransfer rate thereacross during purge.

Another, more specific, advantage of the present invention is that the canister may be quickly configured to provide maximum vapor storage capacity.

Another, more specific, advantage of the present invention is that the canister may be quickly configured with different buffering zone volumes.

Yet another advantage of the present invention is that a single unit may be easily packaged on a particular vehicle line.

Still another advantage of the present invention is reduced flow restriction through the canister.

Yet another advantage of the present invention is reduced potential for hydrocarbon breakthrough.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
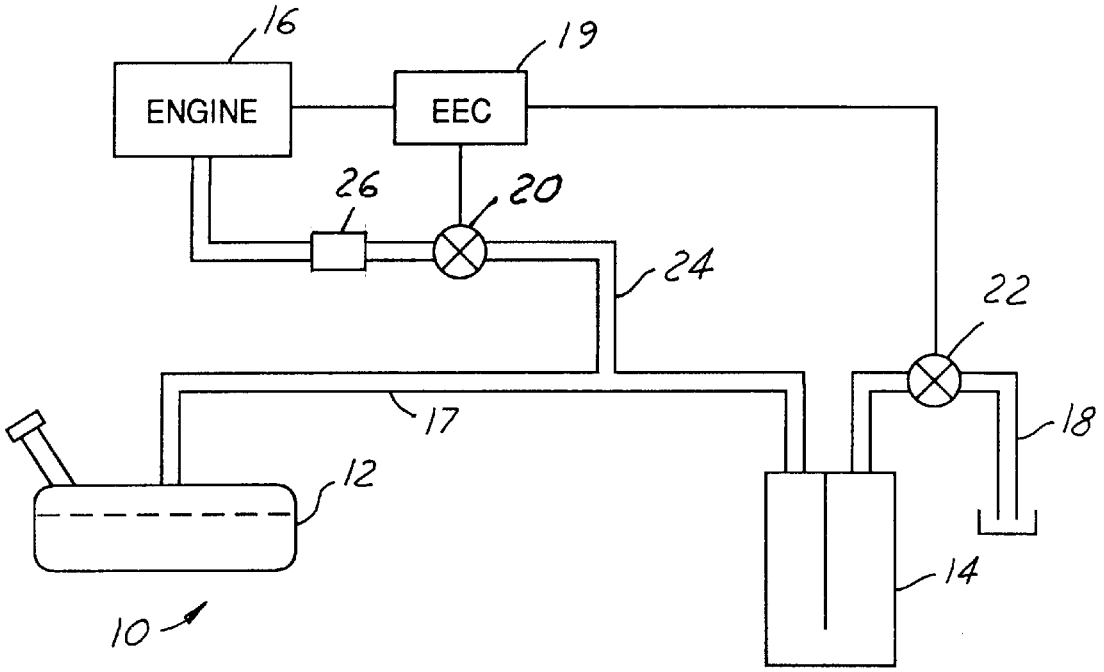
(PRIOR ART) FIG. 1.
FIGS. 1 and 2 are schematic representations of prior art evaporative emissions system s for automotive vehicles.
Figure 2:
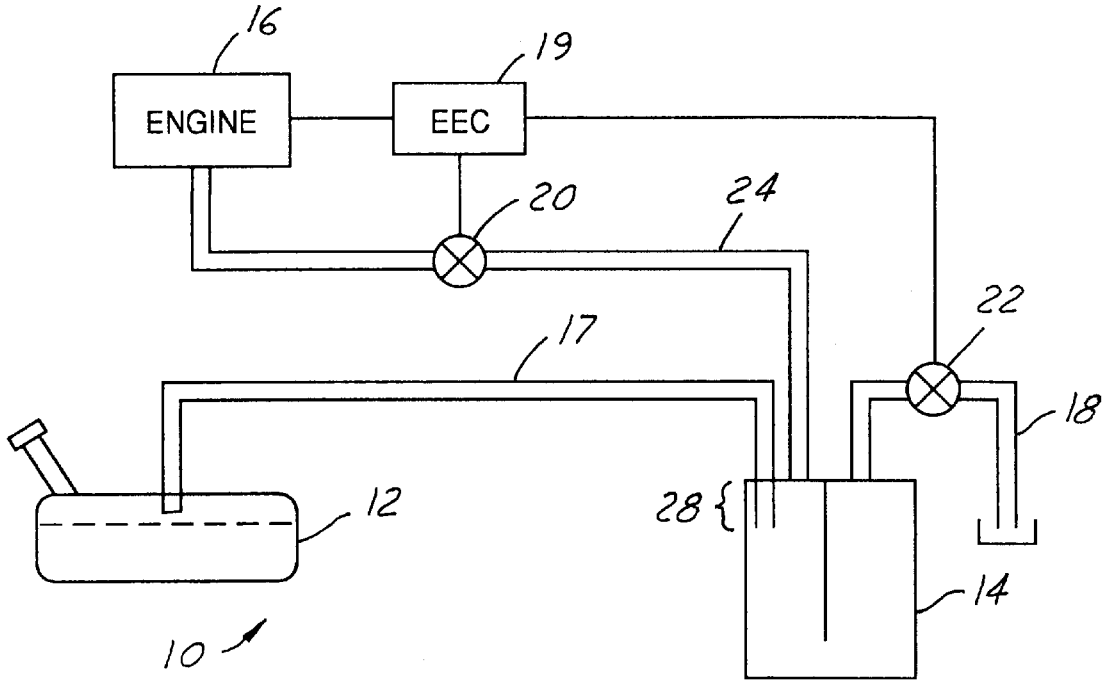
(PRIOR ART) FIG. 2.

Turning first to FIGS. 3, 5, 6*a* and 6*b*, evaporative emissions system 50 includes fuel tank 52 connected to tank vapor purge line 54. Tank vapor purge line 54 is connected to evaporative emissions canister 56 via intermediate port 57. Canister 56, in this example, includes a bed of activated carbon to adsorb hydrocarbon emissions from fuel tank 52. Engine purge line 60 is connected to canister 56 via purge port 61 and communicates between canister 56 and engine 62. Vent line 63 is connected to canister 56, via vent port 68, to vent air to atmosphere. Vapor management valve 64, which is a conventional solenoid actuated valve, is disposed within line 60 and is controlled by engine controller 69. Canister vent valve 66, which may also be a solenoid actuated valve connected to controller 69, is normally open. Valve 66 is closed upon conduction of on-board diagnostic testing (OBD), as is well known to those skilled in the art.

As the volume of vapor increases in fuel tank 52, the vapor flows through line 54 into port 57 to canister 56 where the hydrocarbons are adsorbed and air passes through vent line 63 to the atmosphere. Thus, as is well known to those skilled in the art, canister 56 acts to store hydrocarbons while preventing their release to the atmosphere. Upon purging canister 56, valve 64 is opened and the engine's vacuum serves to draw fresh air through vent port 68 so as to desorb the hydrocarbons stored in canister 56. The hydrocarbons thus released are then routed, via line 60, to engine 62 to be consumed therein.

Figure 5:
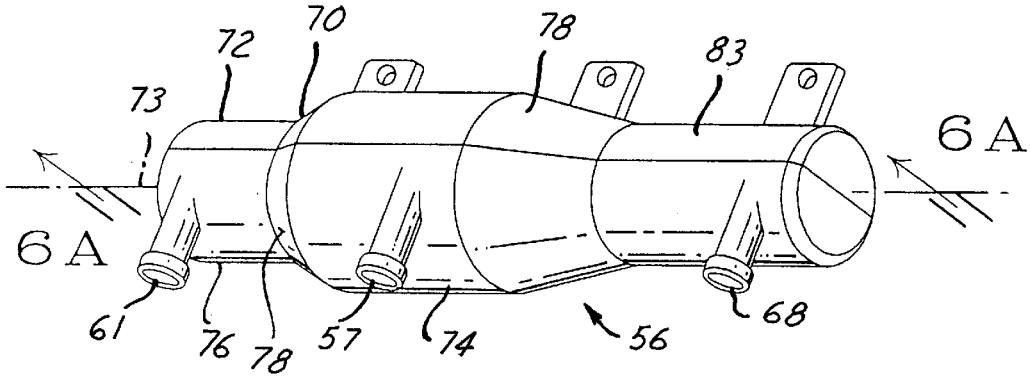
FIG. 5 is a perspective view of an evaporative emissions canister used in the system of FIGS. 3 and 4.
Figure 6A:
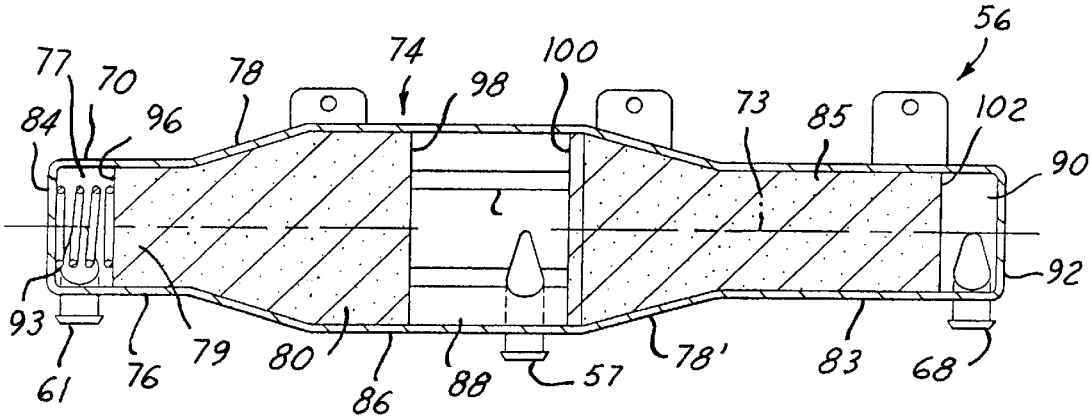
FIGS. 6*a* and 6*b* are side views of alternative configurations of the canister taken along line 6—6 of FIG. 5 and as shown in FIGS. 3 and 4, respectively.
Figure 6B:
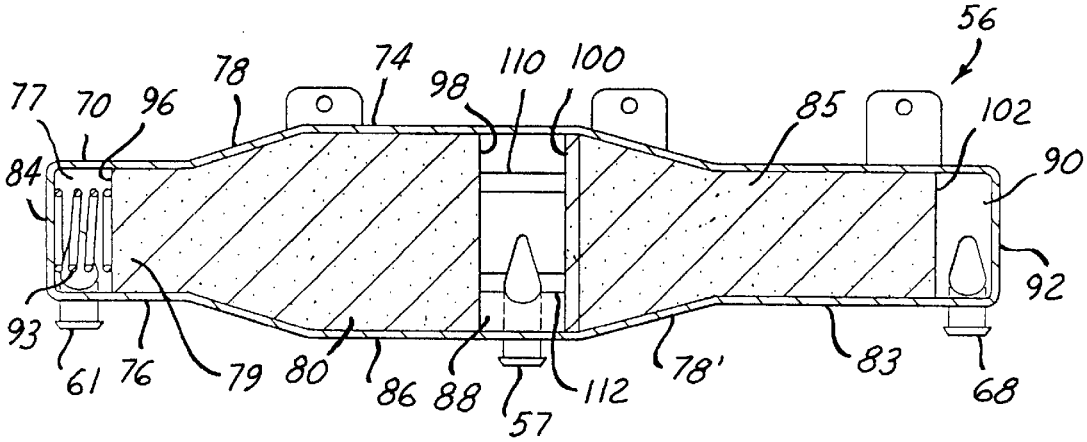

According to one aspect of the present invention, as best shown in FIGS. 5, 6*a* and 6*b*, canister 56 includes a generally cylindrical housing 70 defining circumference 72 and longitudinal axis 73. In a preferred embodiment, housing 70 is formed of a plastic material. A circumferential housing 70 is desirable to create a more even flow distribution through the canister for better carbon bed utilization as well as increased mechanical strength, less housing material per unit volume and reduced flow restriction.

The housing 70 has a first end 84 with a first, relatively smaller cross-sectional area portion 76. A second, relatively larger cross-sectional area portion 74 is connected to the first portion 76 through a tapered section 78. A first hydrocarbon adsorbing zone 80 is substantially or completely disposed in a portion of first area 76 to define first plenum 77 adjacent the first end 84 of housing 70. The first zone 80 is preferably disposed in the first area 76, a portion of in tapered section 78, and a portion of second area 74.

A second hydrocarbon adsorbing zone 85, axially aligned with first hydrocarbon adsorbing zone 80, is disposed in the second area 74 and a third area 83, to define second plenum 88 between first hydrocarbon adsorbing zone 80 and second hydrocarbon adsorbing zone 85. A third plenum 90 is provided adjacent second end 92 of housing 70 adjacent second zone 85. The third area 83 preferably has a reduced cross section to reduce the emissions of vapors to the atmosphere through vent port 68, as described in my copending U.S. patent application Ser. No., 09/118,088, which is incorporated herein by reference.

Using the above described arrangement, we take advantage of the mass transfer theory to maximize canister capacity, particularly during the diurnal cycle and during a purge cycle. In further explanation, the smaller diameter of the first area 76 comprises what is also called a "trailing portion". When the temperature in the fuel system, and particularly the fuel tank 52, rises during the diurnal temperature cycle, fuel vapor partial pressure increases within the fuel tank vapor space 53. The increased pressure forces vapors through the tank vapor purge line 54 into the evaporative emissions canister 56. After the temperature peaks and begins to decline, the pressure decreases within the fuel tank vapor space 53, causing a breathe-back effect, drawing air and some of the vapor residing in the canister 56 back into the fuel tank 52.

Because the smaller diameter portion 79 of the first area 76 has a relatively smaller cross sectional area, the concentration of fuel vapor adsorbed therein will be relatively high compared to the concentration in the vapor line 54, and therefore the mass transfer rate of the vapors across the first area 76 into the canister 56 will be relatively high. This high mass transfer rate enables more fuel vapor to be removed from the canister during the diurnal cycle and therefore maintains the vapor storage capability of the fuel system for a longer time. Similarly, the relatively high vapor concentration in the first area 76 enables a high transfer rate from the canister 56 to the purge line 60 during a purge cycle and to return to the tank 52 upon a reduction of vapor pressure therein.

The larger diameter portion 86 of the first zone provides a larger storage area for the vapors. The hydrocarbon adsorbing zones 80, 85 are axially aligned so that the flow restriction through the canister 56 is minimized. Preferably, the hydrocarbon adsorbing zones 80, 85 are biased with bias spring 93 in a compressed manner. This reduces the potential for a direct leak path through the adsorbing zones. In addition, screens 96, 98, 100 and 102 are positioned at the ends of the zones 80, 85 to contain the carbon.

In a preferred embodiment, a vent port 68 is formed on third portion 83 for venting air to atmosphere upon adsorption of hydrocarbons and for admitting air upon desorption of hydrocarbons during a purging operation of the canister 56. In a preferred embodiment, vent port 68 communicates directly with third plenum 90 and is coupled thereto in a tangential orientation relative to circumference 72 of housing 70 so as to create a swirling flow as fluid enters third plenum 92 upon a purging operation. The swirling flow causes a better desorption of the carbon because a more even flow distribution may be provided across the face of second zone 85.

Figure 3:
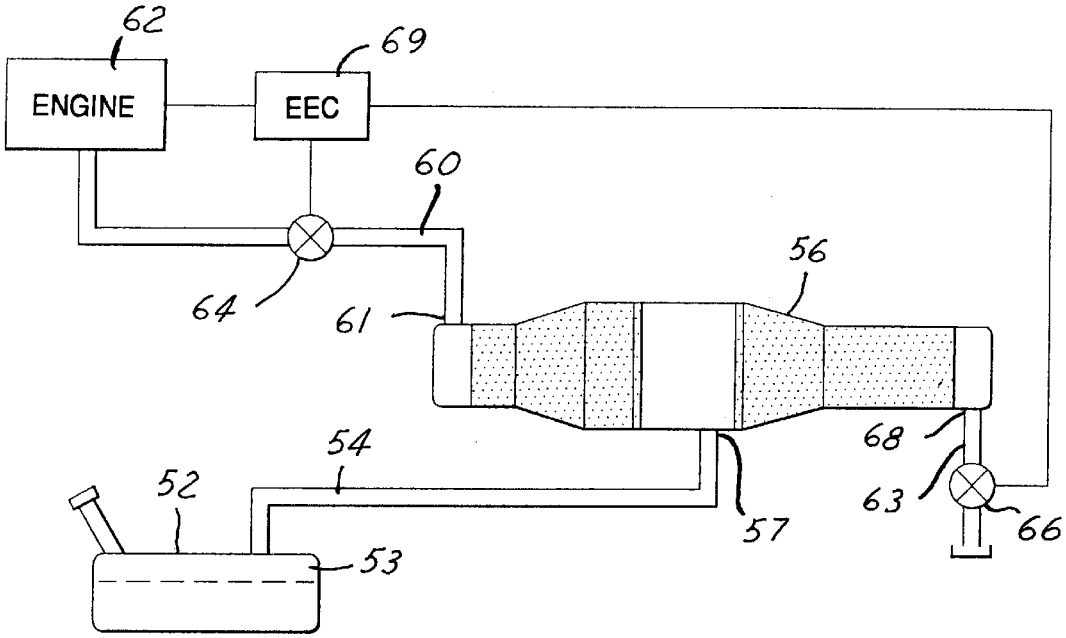
FIG. 3 is a schematic representation of an evaporative emission system for an automotive vehicle according to one aspect of the present invention.

As shown in the embodiment of FIG. 3, a purge port 57 is formed on Second portion 74 and is adapted for connection to engine 62 to allow desorbed hydrocarbon to flow thereto. In a preferred embodiment, Purge port 57 communicates directly with first plenum 90 and is coupled thereto in a tangential orientation relative to circumference 72 of housing 70 so as to create a swirling flow as fluid enters first plenum 90 upon loading the canister.

Intermediate port 57 is formed on second portion 74 and is disposed between vent port 68 and purge port 61. Intermediate port 57 communicates directly with second plenum 88 and is coupled thereto in a tangential orientation relative to circumference 72 of housing 70 so as to create a swirling flow as fluid enters second plenum 88 upon loading the canister.

According to the present invention, intermediate port 57 is selectively coupled to fuel tank 52. When fuel vapor from tank 52 is directly purged into intermediate port 57, first hydrocarbon adsorbing zone 80 acts as a hydrocarbon buffer. This buffer zone acts to dampen any vapor spikes when purging from the tank directly to the engine, as is shown in the configuration of FIG. 3.

Figure 4:
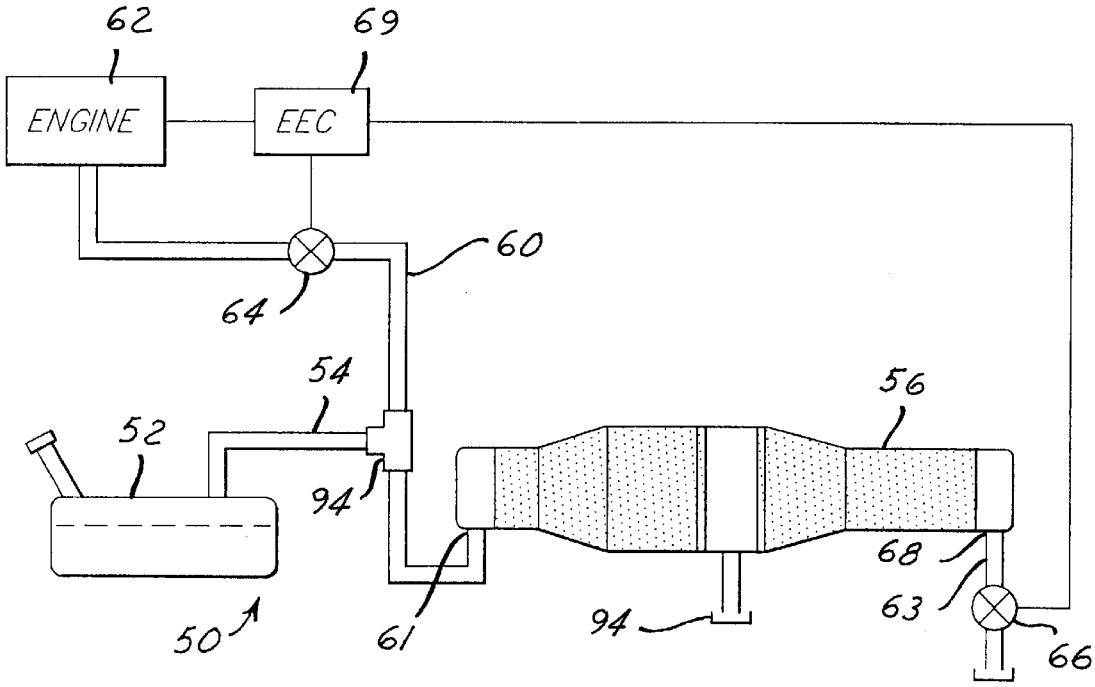
FIG. 4 is a schematic representation of an evaporative emission system for an automotive vehicle according to another aspect of the present invention.

Alternatively, system 50 may be configured as shown in FIG. 4. In this configuration, intermediate port 57 is plugged with cap 94 and line 54 is directly connected to line 60 via "T" connector 94. Thus, when fuel vapor from tank 52 is directly purged into purge port 61 and when intermediate port 57 is closed, first hydrocarbon adsorbing zone 80 cooperates with second hydrocarbon adsorbing zone 85 such that both zones adsorb hydrocarbons. In this configuration, when no buffer zone is required for the particular vehicle line, the entire carbon available may be utilized to store the hydrocarbons.

In a preferred embodiment, second plenum 88 is adapted to receive standoffs 110, 112. Standoffs 110, 112 separate first hydrocarbon adsorbing zone 80 and second hydrocarbon adsorbing zone 85. The standoffs are sufficiently sized in length so as to accommodate a plurality of sizes of first hydrocarbon adsorbing zone 80 and/or second hydrocarbon adsorbong zone 85. That is, when a relatively large buffer zone is required, standoffs 110, 112 are relatively small, as shown in FIG. 6*b*. On the other hand, when a relatively small buffer zone is required, standoffs 110, 112 are relatively large, as shown in FIG. 6*b*. In addition, when no buffer zone is required such that port 57 is plugged and zone 80 cooperates with zone 85 to create a relatively high capacity canister, standoffs 110, 112 are or made relatively small, as shown in FIG. 6*b*.

Figure 7:
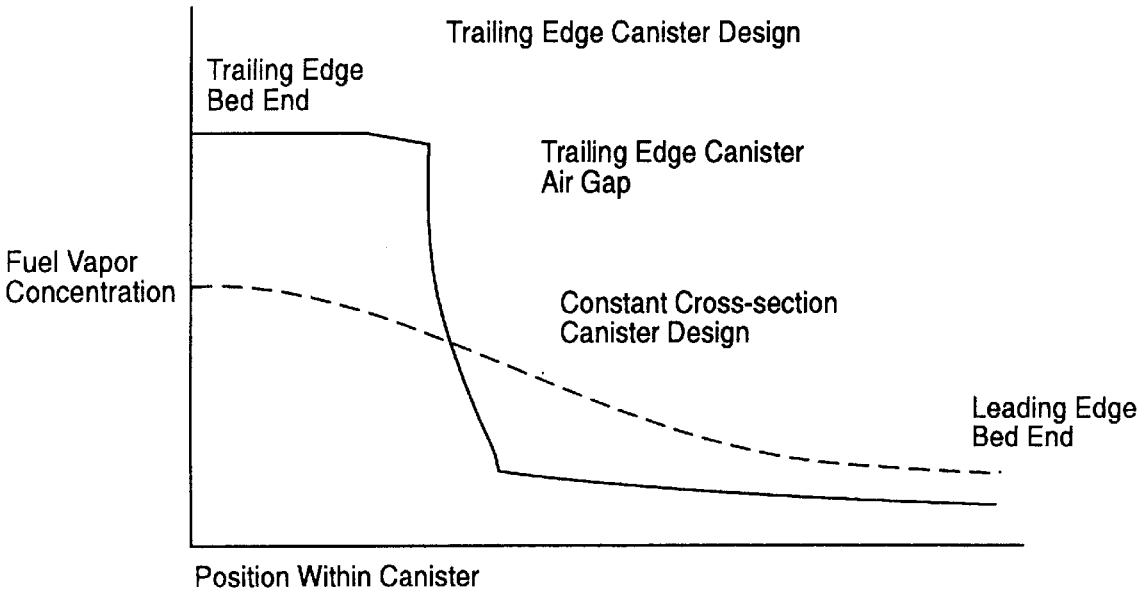
FIG. 7 provides a graph to illustrate the relationship of fuel vapor concentration to the position in the canister for the prior art design and the present invention.

The graph in FIG. 7 illustrates the relationship of fuel vapor concentration to the position in the canister for the prior art design and the present invention. As shown therein, the solid line represents the present invention, where a large vapor concentration is present in the reduced cross-sectional area portion. As the position moves to the right, one enters the larger cross sectional area, and the concentration decreases. As described above, this results in a high mass transfer rate at the smaller cross sectional portion.

Figure 8:
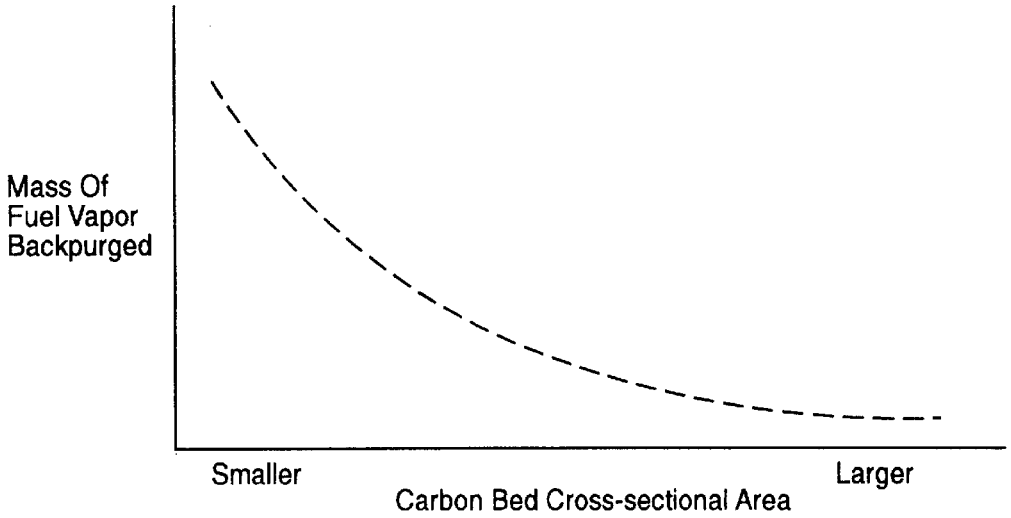
FIG. 8 provides a graph to show the relationship of the mass of the fuel vapor purged to the cross sectional area of the canister.

As shown in the graph of FIG. 8, the relationship of the mass of the fuel vapor purged to the cross sectional area of the canister results in a greater mass of fuel backpurged with a smaller cross sectional area.

In an alternative embodiment, the second end 92 does not have a reduced cross section as shown in the Figures, but has substantially a constant cross section with the second portion 74.

While the best modes for carrying out the invention have been described in detail, those skilled in the art in which this invention relates will recognize various alternative designs and embodiments, including those mentioned above, in practicing the invention that has been defined by the following claims.

We claim:

1. An evaporative emissions canister for an evaporative emission system, the vehicle having a fuel tank coupled to an engine via a vapor purge line, said canister coupled to the fuel tank and the engine, said canister comprising:

a generally cylindrical housing defining a circumference and having a first, relatively smaller cross-sectional area portion, a second, relatively larger cross-sectional area portion, a tapered section therebetween, and a third cross-sectional area portion, with said housing containing hydrocarbon adsorbing material for adsorbing hydrocarbons from fuel vapor flowing therethrough:

a vent port formed on said third cross-sectional area portion for venting air to atmosphere upon adsorption of hydrocarbons and for admitting air upon desorption of hydrocarbons during a purging operation of said canister;

a purge port formed on said first portion and adapted for connection to the engine to allow desorbed hydrocarbon to flow thereto;

an intermediate port formed on said second portion and disposed between said vent port and said purge port, with said intermediate port being selectively coupled to the fuel tank;

a first hydrocarbon adsorbing zone disposed in said housing between said purge port and said intermediate port; and a second hydrocarbon adsorbing zone disposed in said housing between said intermediate port and said vent port.

2. A canister according to claim 1 further comprising said second portion having a reduced end opposite the first portion, the vent port being formed on the reduced end of the second portion.

3. A canister according to claim 1 wherein said first hydrocarbon adsorbing zone resides substantially in said second portion of said housing, said first portion, and said tapered portion of said housing.

4. A canister according to claim 1 wherein said second hydrocarbon adsorbing zone resides exclusively in said second portion of said housing.

5. A canister according to claim 4 further comprising said second portion having a reduced end opposite the first portion, the vent port being formed on the reduced end of the second portion.

6. A canister according to claim 5 wherein said first hydrocarbon adsorbing zone acts as a hydrocarbon buffer when fuel vapor from the tank is directly purged into said intermediate port.

7. A canister according to claim 3 wherein said first hydrocarbon adsorbing zone cooperates with said second hydrocarbon adsorbing zone such that both zones adsorb hydrocarbons when fuel vapor from the tank is directly purged into said purge port and when said intermediate port is closed.

8. A canister according to claim 1 further comprising:

said second portion having a reduced end opposite the first portion, the vent port being formed on the reduced end of the second portion;

a first plenum disposed within said housing between a first end of said housing and said first hydrocarbon adsorbing zone, with said purge port communicating directly with said first plenum;

a second plenum disposed within said housing between said first hydrocarbon adsorbing zone and said second hydrocarbon adsorbing zone, with said intermediate port communicating directly with said second plenum; and, a third plenum disposed within said housing between said second hydrocarbon adsorbing zone and a second end of said housing, with said vent port communicating directly with said third plenum.

9. A canister according to claim 8 wherein said second plenum is adapted to receive at least one of a plurality of standoffs, with said standoff separating said first and said second hydrocarbon adsorbing zones, with said plurality of standoffs each being sufficiently sized so as to accommodate a plurality of sizes of said first hydrocarbon adsorbing zone, respectively.

10. A canister according to claim 1 further comprising a biasing means to bias said first and said second hydrocarbon adsorbing zones in a compressed manner.

11. An evaporative emissions canister for an evaporative emission system, the vehicle having a fuel tank coupled to an engine via a vapor purge line, said canister coupled to the fuel tank and the engine, said canister comprising:

a generally cylindrical housing defining a circumference having a first, relatively smaller cross-sectional area portion, a second, relatively larger cross-sectional area portion, a tapered portion therebetween, and a third cross-sectional area portion;

a first hydrocarbon adsorbing zone disposed in a portion of said first area, said tapered section, and a portion of said second area;

a second hydrocarbon adsorbing zone entirely disposed in a portion of said second area to define a second plenum adjacent a second end of said housing, wherein said first hydrocarbon adsorbing zone cooperates with said second hydrocarbon adsorbing zone such that both zones adsorb hydrocarbons when fuel vapor from the tank is directly purged into said purge port and when said intermediate port is closed;

a first plenum defined between said first and second hydrocarbon adsorbing zones and a third plenum adjacent a first end of said housing;

a vent port formed on said third cross-sectional area portion for venting air to atmosphere upon adsorption of hydrocarbons and for admitting air upon desorption of hydrocarbons during a purging operation of said canister, with said vent port communicating directly with said third plenum and being coupled thereto in a tangential orientation relative to said circumference of said housing so as to create a swirling flow as fluid enters said third plenum;

a purge port formed on said first portion and adapted for connection to the engine to allow desorbed hydrocarbon to flow thereto, with said purge port communicating directly with said first plenum and being coupled thereto in a tangential orientation relative to said circumference of said housing so as to create a swirling flow as fluid enters said first plenum; and, an intermediate port formed on said first portion and disposed between said vent port and said purge port, with said intermediate port communicating directly with said second plenum and being coupled thereto in a tangential orientation relative to said circumference of said housing so as to create a swirling flow as fluid enters said second plenum, with said intermediate port being selectively coupled to the fuel tank.

12. A canister according to claim 11, wherein said first hydrocarbon adsorbing zone acts as a hydrocarbon buffer when fuel vapor from the tank is directly purged into said intermediate port.

13. A canister according to claim 11 further comprising said second portion having a reduced end opposite the first portion, the vent port being formed on the reduced end of the second portion.

14. A canister according to claim 11 wherein said second plenum is adapted to receive at least one of a plurality of standoffs, with said standoff separating said first and said second hydrocarbon adsorbing zones, with said plurality of standoffs each being sufficiently sized so as to accommodate a plurality of sizes of said first hydrocarbon adsorbing zone, respectively.

15. An evaporative emissions system comprising:

a fuel tank coupled to an engine via a vapor purge line; and a hydrocarbon adsorbing canister coupled to the fuel tank and the engine, with said canister comprising:

a generally cylindrical housing defining a circumference and having a first, relatively smaller cross-sectional area portion, a second, relatively larger cross-sectional area portion, a tapered section therebetween, and a third cross-sectional area portion;

a first hydrocarbon adsorbing zone disposed in a portion of said first area, said tapered section, and a portion of said second area to define a first plenum adjacent a first end of said housing;

a second hydrocarbon adsorbing zone entirely disposed in a portion of said second area to define a third plenum adjacent a second end of said housing and a second plenum between said first and second hydrocarbon adsorbing zones;

a vent port formed on said second portion for venting air to atmosphere upon adsorption of hydrocarbons and for admitting air upon desorption of hydrocarbons during a purging operating of said canister, with said vent port communicating directly with said third plenum and being coupled thereto in a tangential orientation relative to said circumference of said housing so as to create a swirling flow as fluid enters said third plenum;

a purge port formed on said first portion and adapted for connection to the engine to allow desorbed hydrocarbon to flow thereto, with said purge port communicating directly with said first plenum and being coupled thereto in a tangential orientation relative to said circumference of said housing so as to create a swirling flow as fluid enters said first plenum; and an intermediate port formed on said first portion and disposed between said vent port and said purge port, with said intermediate port communicating directly with said second plenum and being coupled thereto in a tangential orientation relative to said circumference of said housing so as to create a swirling flow as fluid enters said second plenum, with said intermediate port being selectively coupled to the fuel tank, said first hydrocarbon adsorbing zone acts as a hydrocarbon buffer when fuel vapor from the tank is directly purged into said intermediate port, and said first hydrocarbon adsorbing zone cooperates with said second hydrocarbon adsorbing zone such that both zones adsorb hydrocarbons when fuel vapor from the tank is directly purged into said purge port and when said intermediate port is closed.

16. A system according to claim 15 further comprising said second portion having a reduced end opposite the first portion, the vent port being formed on the reduced end of the second portion.

* * * * *